US006805303B2

(12) United States Patent
Hess et al.

(10) Patent No.: US 6,805,303 B2
(45) Date of Patent: Oct. 19, 2004

(54) LIQUID DROPLET SPRAY DEVICE

(75) Inventors: Joseph Hess, Bevaix (CH); Bo Hu, Neuchâtel (CH)

(73) Assignee: Microflow Engineering SA, Neuchatel (CH)

( * ) Notice: Subject to any disclaimer, the term of this patent is extended or adjusted under 35 U.S.C. 154(b) by 163 days.

(21) Appl. No.: 10/232,828

(22) Filed: Sep. 3, 2002

(65) Prior Publication Data

US 2003/0066904 A1 Apr. 10, 2003

(30) Foreign Application Priority Data

Sep. 3, 2001 (EP) ..... 01121074

(51) Int. Cl.[7] ..... B05B 1/08; B05B 3/04; B05B 1/14; B05B 1/00

(52) U.S. Cl. ..... 239/102.2; 239/102.1; 239/554; 239/596

(58) Field of Search ..... 239/102.2, 102.1, 239/554, 596, 548, 555–557

(56) References Cited

U.S. PATENT DOCUMENTS 4,465,234 A 8/1984 Maehara et al.
4,550,325 A * 10/1985 Viola ..... 347/68
6,669,103 B2 * 12/2003 Tsai ..... 239/4

FOREIGN PATENT DOCUMENTS

EP 0 516 565 A1 12/1992
EP 0 923 957 A1 6/1999
EP 1 022 063 A1 7/2000
WO WO 95/15822 6/1995

OTHER PUBLICATIONS

European Search Report dated Feb. 14, 2002.

* cited by examiner

*Primary Examiner*—Michael Mar
*Assistant Examiner*—Darren Gorman
(74) *Attorney, Agent, or Firm*—Griffin & Szipl, P.C.

(57) ABSTRACT

The invention concerns a liquid droplet spray device for atomising a liquid substance, comprising a housing comprising a first substrate, a second substrate superposed on the first substrate and a space enclosed by said first and second substrates for containing the liquid substance. An outlet means is arranged in at least one of said first or second substrates and comprises at least one outlet nozzle (19) and at least one output channel (20) connecting the space (12) to each outlet nozzle (19). A vibrating element (18) is disposed to vibrate liquid in said space (12) so as to eject said liquid substance as a spray through said outlet nozzles (19). According to the present invention, each output channel (20) has a first portion **(20*a*), a second portion (20*b*) and a third portion, said first portion being arranged adjacent said space (12)** and having straight sidewalls, said third portion also having straight sidewalls, the width of said first portion being larger than the width of said third portion, said second portion connecting said first portion to said third portion such that the width of the output channel changes progressively from the width of said first portion to the width of said third portion.

45 Claims, 3 Drawing Sheets

LIQUID DROPLET SPRAY DEVICE

Figure 1:
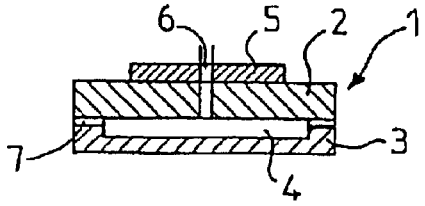

The present invention relates to a liquid droplet spray device suitable for atomising a liquid substance such as a drug, a fragrance or other atomised liquids. Such a device may be used, e.g., for perfume dispensers or for administrating an atomised or nebulised drug to a patient by means of his or her respiratory system. Such a device, in its simplest form, is commonly called an atomizer. The device delivers the liquid substance as a dispersion of atomised droplets. More specifically, the present invention concerns an improved liquid droplet spray device that efficiently creates and expels a controllable liquid droplet spray.

Various liquid droplet spray devices are known for atomising a liquid. For instance, the document EP 0 516 565 describes an ultrasonic wave nebuliser which atomises water. This apparatus is used as a room humidifier. Vibration is transmitted through the water to the water surface from which the spray is produced. A perforate membrane is provided to retain the water in absence of oscillation.

Typically, inhaler devices use the same principle to atomise the liquid substance into droplets, see for example the document WO 95/15822.

As is known, the droplet size depends on the size of the outlet orifices of the perforate membrane, and also depends on the vibration frequency. In order to obtain a small droplet, a very high frequency should be used, typically over 1 MHz for droplets of about 10 $\mu$m in diameter. Generally, the higher the frequency, the smaller the droplet diameter may be. This leads to increased power consumption due to the high frequency so that such a device is not suitable for a small battery operated device.

Another liquid droplet spray device is known from the document EP-A-0 923 957 in the name of the present Applicant. The described liquid droplet spray device consists of a housing formed of a superposition of a first substrate and a second substrate in-between which a chamber or a space is formed for containing a liquid substance and thus providing a compression chamber. Outlet means are provided in a thinner membrane section of the first substrate. The outlet means consists of a cavity, which partly constitutes the chamber, outlet nozzles and output channels connecting these nozzles to the chamber. The liquid substance enters the chamber or space of spray device by way of, e.g., a very low pressure, e.g., around a few millibars, or capillary action. The spray device further comprises a vibrating element, e.g. a piezoelectric element to cause vibration of the liquid substance in the space. By vibrating the liquid substance, the liquid enters the outlet means and a droplet spray is generated as the liquid is expelled from the device.

This prior art document further describes techniques allowing for such output channels with a straight, non-tapered profile. This provides for a precisely defined pressure drop, droplet size and flow behaviour across the output channel for aqueous solutions and suspensions whereas the relatively smooth surface is suited for medications carrying small solid particles, e.g. from less than 1 to approx 2 $\mu$m, in suspensions. The same effect can be obtained proportionally with larger dimensions, e.g. with nozzles of 10 $\mu$m or larger for example for perfume dispensing applications.

The diameter of an expelled droplet depends on the nozzle hole size "d" for a given frequency of the vibration of the liquid substance and the inlet pressure. In this prior art device where a frequency of around 243 kHz is used, the mean droplet diameter has been found to be around 5 $\mu$m, the diameter of the hole of the outlet nozzle is around 7 $\mu$m and the inlet pressure is a few millibars. One such a droplet thus contains a quantity of around 67 femtolitres ($10^{-15}$l) so that as such the number of nozzles may be determined as a function of the amount to be ejected.

Indeed, the fabrication tolerance $\Delta d$ of the outlet nozzles is an essential factor in controlling and determining the amount, i.e. the volume "V" of an expelled droplet. In fact, this volume V depends on $d^3$($V=\frac{1}{6}*\Pi d^3$), d being the diameter of the outlet nozzle.

For example, if d=5 $\mu$m, and $\Delta d=\pm 0.5$ $\mu$m, the droplet volume V may vary from 47.5(d=4.5) to 87(d=5.5) which is a variation of 83%.

Furthermore, it is known that the pressure drop across the output channel depends on $d^4$, so it may be understood that the outlet diameter, the channel diameter, its cross-section, as well as any combination of varying micro-machined cross-sections of the outlet channel and nozzle are an important factor in the structure of the liquid droplet spray device.

It is also known that the droplet diameter varies with certain physico-chemical properties of the liquid such as surface tension and viscosity. It is therefore important as shown in the cited prior art to be able to adapt the physical and electrical device parameters (frequency and amplitude) according to the liquid to be expelled and the desired droplet characteristics.

The applicant has now found that although the prior art device generally functions satisfactorily, the construction of this device results in an elaborate manufacturing so that in certain applications, such as for ambient fragrance dispensing, the described device would appear expensive. Furthermore, the manner in which such device needs to be re-filled after dispensing the spray could under certain circumstances also be awkward.

Moreover, when using the spray device to expel a fragrance, it is known that the diffusion of scent in the air is directly related to the surface of the droplet available in the surrounding air. Thus, the smaller the droplet, the smaller its surface. This changes the diffusion rate of the scent, because, as the liquid droplet radius decreases, its surface-to-volume ratio increases. However, the surface of an expelled droplet is not stable so that it may explode sooner than expected resulting in a change of the scent diffusion as a function of the droplet size. In fact, the applicant has observed that the smaller the droplet, the less stable the droplet.

Indeed, according to the Kelvin effect, if the saturation of the gas-phase compared to the liquid-phase is above unity, then the thermodynamic stability of the droplet as compared to the gas-phase is favoured by the energy release of forming a 3D liquid, but is disfavoured by the formation of the 2D surface. The net result is an increase in the free energy per liquid molecule as the radius of the droplet decreases: This effect is observed as an increasing vapour pressure as the liquid droplet decreases in radius.

The following table gives an example of the equilibrium vapour pressure increase over a pure water droplet as a function of the droplet diameter at the temperature T=298° K:

| $D_p$ ($\mu$m) | 1.0 | 0.5 | 0.1 | 0.05 | 0.01 | 0.005 |
|---|---|---|---|---|---|---|
| $\Delta P$ (%) | 0.21 | 0.42 | 2.1 | 4.3 | 23 | 52 |

where $D_p$ is the liquid droplet diameter in microns ($10^{-6}$ m), and $\Delta P$ is the pressure change in percentage.

As may be seen, the pressure increases when the droplet radius (diameter) decreases due to the Kelvin effect.

It is, therefore, an object of the present invention to provide a liquid droplet spray device which overcomes the above-mentioned inconveniences and which, due to the generally very small droplet size dispensed, allows to take into account the Kelvin effect.

It is another object of the present invention to provide such a device that is simple, reliable to manufacture, small in size and low in energy consumption and cost.

Thus, the present invention concerns a liquid droplet spray device as defined in the appended claims.

Thanks to the construction of the spray device according to the present invention and, in particular to the specific shape and arrangement of its outlet means, an efficient device may be obtained in a relatively simple and inexpensive manner.

Figure 2B:
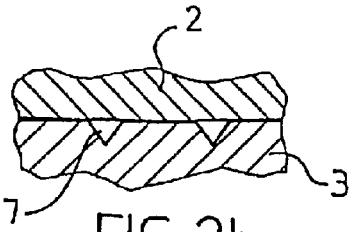
Figure 2A:
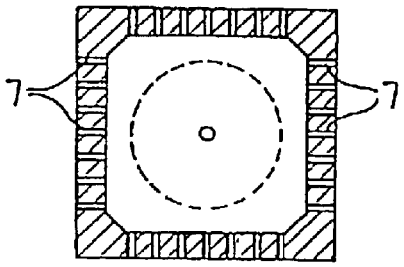
Figure 3A:
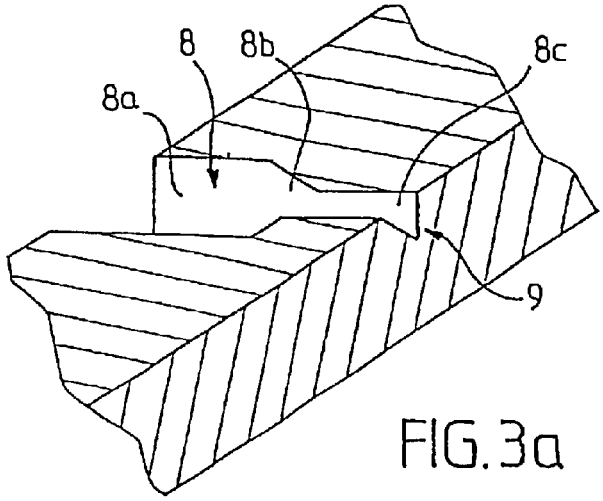
Figure 4:
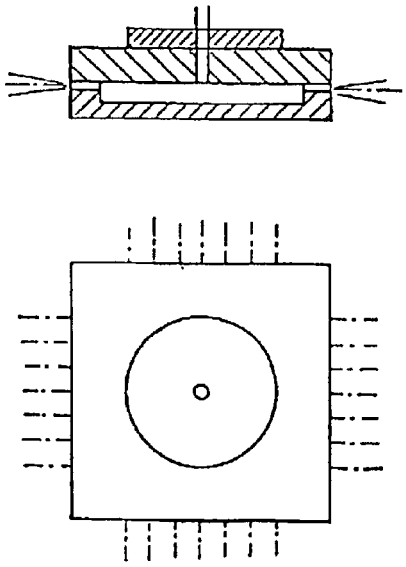
Figure 5A:
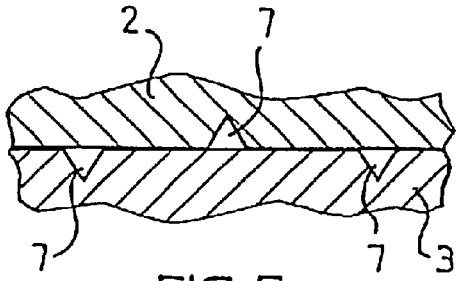
Figure 5B:
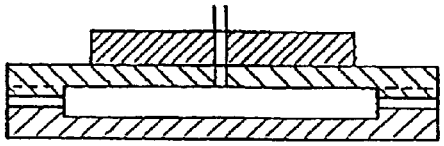
Figure 6:
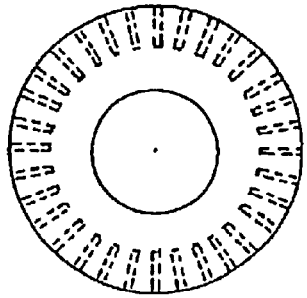
Figure 7A:
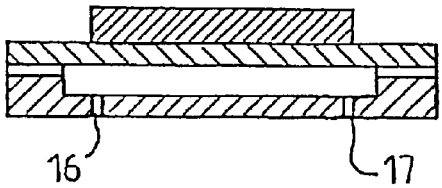
Figure 8A:
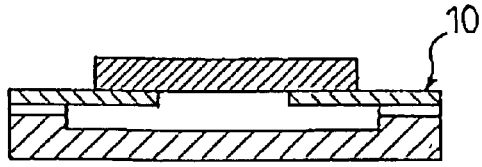
Figure 7B:
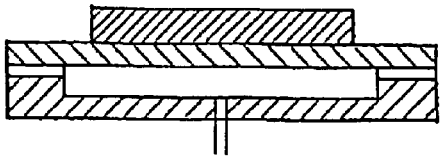
Figure 8B:
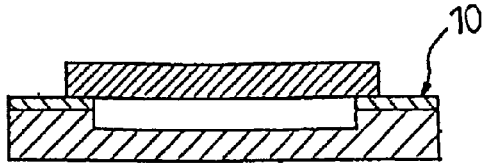
Figure 9:
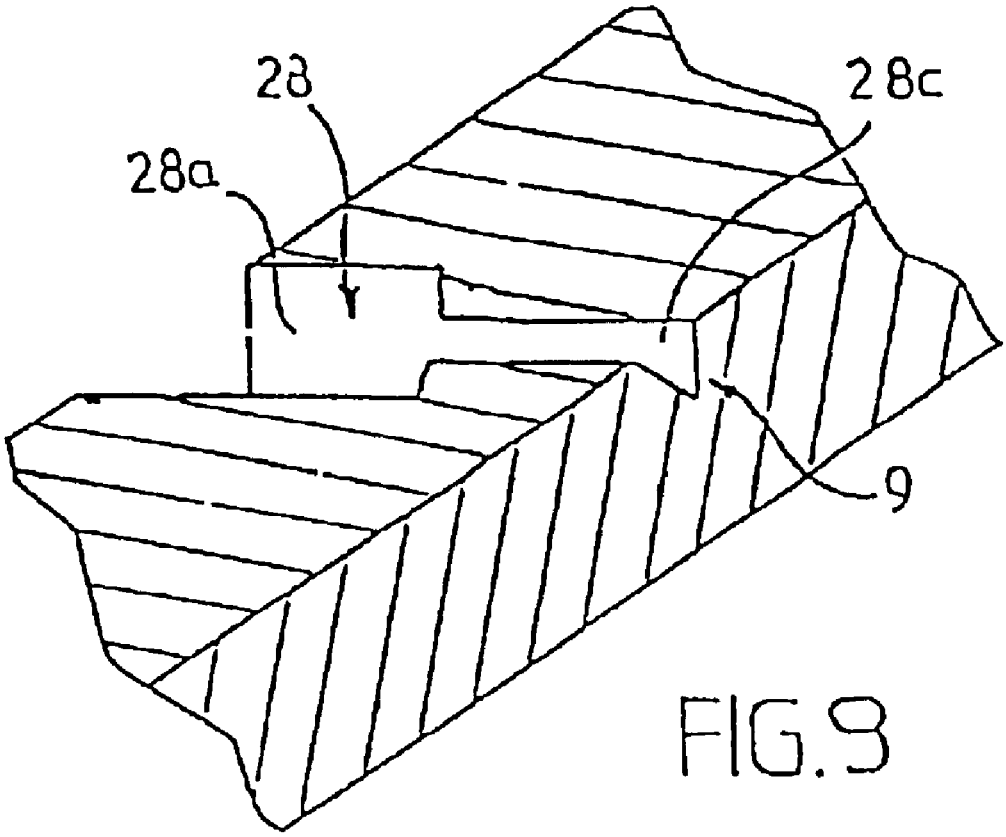

Other features and advantages of the liquid spray device according to the present invention will become clear from reading the following description, which is given solely by way of a non-limitative example thereby referring to the attached drawings in which:

FIG. 1 is a schematic cross-section of a first embodiment of the liquid droplet spray device according to the present invention, FIG. 2A shows a schematic top view of the liquid droplet spray device of FIG. 1 where the first substrate is transparent, FIG. 2B shows a schematic side view of the liquid droplet spray device of FIG. 1, FIGS. 3A to 3C show schematically detailed cross-sectional views of the second substrate with the outlet means therein, FIG. 4 shows a liquid droplet spray device according to the present invention in operation, FIGS. 5A and 5B show schematic cross-sections of an alternative where outlet means are provided in both the first and the second substrate of the liquid droplet spray device according to the present invention, FIG. 6 shows another preferred embodiment of a rounded liquid droplet spray device according to the present invention, FIGS. 7A and 7B show a variant of the liquid droplet spray device according to the present invention with the inlet channel provided in the second substrate, FIG. 8 shows a schematic cross-section of another preferred embodiment of the liquid droplet spray device according to the present invention, and FIG. 9 shows a further embodiment of the liquid droplet spray device according to the present invention.

An example of a first preferred embodiment will be described hereafter. The present invention thus concerns a liquid droplet spray device for atomising a liquid substance. FIG. 1 shows a cross-section of the first embodiment. The liquid droplet spray device is indicated by general reference numeral 1 and consists in this example of a housing comprising a superposition of a first substrate 2 and a second substrate 3. Within the housing, an empty space, i.e. a chamber 4 is provided for receiving a liquid substance. This space 4 may be created by etching away a part of a top surface of one of the substrates. In this example, a part of the top surface of second substrate 3 is etched, by using well known etching techniques such as known from the field of semiconductors and as described in the above-mentioned prior art, so that a thinner middle section and a thicker edge section is then obtained as shown. Thus, when the flat bottom surface of first substrate 2 is attached to the etched surface of second substrate 3, the space will be enclosed thereby forming a chamber 4. Substrates 2 and 3 are attached to each other by appropriate bonding techniques well known to a skilled person, preferably by using anodic bonding.

A vibrating element, such as a piezoelectric element 5 is disposed on the housing to vibrate the liquid substance once it is present in space 4. Preferably, vibrating element 5 is arranged directly on first substrate 2 and transmits the vibration to this substrate as well as to the liquid substance, e.g. in a manner as known from the above-mentioned document EP-A-0 923 957. In order to allow the liquid substance to enter the housing, suitable inlet means 6 are provided for connecting an external liquid reservoir, not shown, to the liquid droplet spray device. In this example, the inlet means consist of a channel traversing vibrating element 5 and first substrate 2. Further appropriate connecting means may be provided to link inlet means 6 to the external reservoir.

Outlet means 7 are further provided in the housing allowing the liquid substance to exit the housing. In fact, when the liquid contained in space 4 is excited by vibrating element 5 at an appropriate frequency, in the present case around 300 kHz, and under an appropriate low pressure, it will be ejected as a spray of droplets through the outlet means with a very low exit velocity. Outlet means 7 consists of at least one outlet nozzle and at least one output channel connecting space 4 to each outlet nozzle, as will be explained in more detail hereafter.

FIG. 2A shows a top view of the liquid droplet spray device 1 where first substrate 2 is transparent. As can be seen, outlet means 7 are arranged in the thicker edge section of second substrate 3 along its entire periphery. The number of outlet means can be adapted according to the requirements.

As can be seen from FIG. 2B, the outlet means are arranged in second substrate 2 so as to connect space 4 to the exterior of the spray device thus allowing the liquid to be expelled as a spray.

Figure 3B:
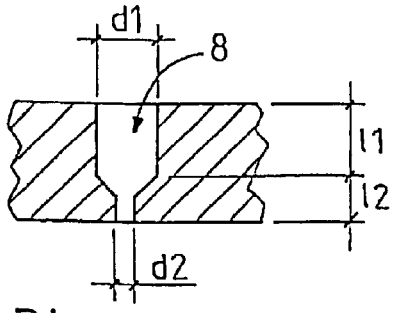
Figure 3C:
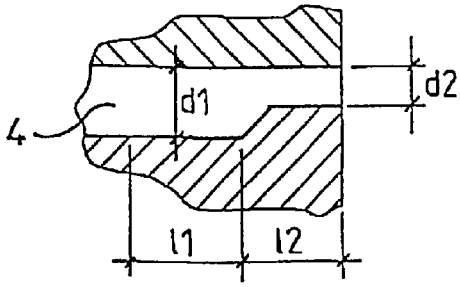

According to the present embodiment, each output channel, indicated by reference numeral 8 in FIG. 3, consists of three portions, a first portion 8*a*, a second portion 8*b* and a third portion 8*c*. As shown in FIGS. 3A to 3C, first portion 8*a* of output channel 8 is arranged adjacent space 4 and has straight sidewalls. Third portion 8*c* also has straight sidewalls. As can be seen, output channel 8 has a necked shape, going from a larger channel section adjacent space 4 to a narrower section adjacent the outlet nozzle, indicated by reference numeral 9. In fact, the width $d_1$ of first portion 8*a* is larger than the width $d_2$ of third portion 8*c*, and second portion 8*b* connects first portion 8*a* to third portion 8*c* such that the width of output channel 8 changes progressively along second portion 8*b* from width $d_1$ to width $d_2$. FIG. 9 shows another embodiment using only 2 portions, a wider portion 28*a* adjacent to the inner space 4, and a narrow portion 28*c* adjacent the outlet nozzle 9. Both channel portions 28*a* and 28*c* also have straight sidewalls. Such an embodiment can easily be machined into various materials as implied in FIG. 6 and as explained in co-pending application EP 01 103 653.0 in the name of the present applicant. The cross-section can be triangular or rounded as can be easily imagined. The structure may be created, e.g., by depositing the material required for the structure instead of etching it by KOH or by machining the structure by laser or microinjection moulding etc.

Outlet means 7 may be manufactured by etching, e.g. by wet-etching or anisotropic etching or the like, the thicker edge section of second substrate 3 so as to obtain grooved portions, these grooved portions corresponding to the output channel portions 8*a*, 8*b* and 8*c*.

An advantage of this embodiment using two portions is that by varying the alignment of the narrow portion 28*c* with respect to the wider portion 28*a*, it is possible to obtain a variation in the direction of the spray ejected form the spray device. As may be understood, by having both portions aligned in a concentric manner, the droplet ejected there through will travel perpendicular to the outlet nozzle. However, if the narrow portion is eccentric with respect to the wider portion, the ejected droplet will not be ejected perpendicular to the outlet nozzle, but at an angle depending on the eccentricity. Clearly, in this manner, it is thus possible to obtain a convergent or a divergent ejected spray due to the alignment of the stepped portions.

In an embodiment created by the Applicant in the above described manners, it was possible to obtain, using substantially square substrates of about 7 $cm^2$, 71 outlet per side, i.e. a total 284 outlet means in the liquid droplet spray device.

FIG. 4 shows a liquid droplet spray device according to the present invention in operation. As can be seen, the droplet spray ejects from all sides of the spray device so that this device could be called a side-shooter.

Advantageously, if more outlet means are required, for instance when more liquid is to be distributed as a spray, it is possible to also create outlet means in first substrate 2 in a similar manner. As shown in FIGS. 5A and 5B, the outlet means in first substrate 2 should of course be shifted with respect to those in second substrate 3 to avoid any overlap. As such, a higher density of outlet means in the spray device may be obtained. In an embodiment thus created, 568, i.e. double the amount of outlet means could be obtained when using the same-sized substrates (7 $cm^2$).

Naturally, the outlet means need not be created in second substrate 3, but could be created in first substrate 2 instead, or even in both, in an identical manner as described above for second substrate 2.

Suitable materials for the substrates include glass, ceramics, silicon, high-density polymer, plastic, photo resist, metal or the like. In fact, the material used for the substrates needs to suitable so as to allow for etching, machining or depositing material in a manner as mentioned above so as to create the inner space 4 and the outlet means 7.

In another preferred embodiment, as shown in FIG. 6, the liquid droplet spray device is substantially round, and may be fabricated by using e.g. two round wafers, or even two disks normally used for manufacturing compact disks, that have been suitably machined as explained above, coated as needed and that are appropriately bonded to each other.

This embodiment, as well as the other embodiments, may contain one or more spaces 4 each containing a liquid substance to be dispensed. Each space may contain a same or a different liquid substance. Of course, in such a case, a corresponding number of vibrating elements or actuators are used to activate said several different liquids substances individually or jointly as a function of control commands. In this manner, a spray can be expelled which is formed by a combination of the liquid substances. Such an embodiment might be used to supply scents to a person, e.g., a viewer watching a film with scents triggered in an appropriate manner, a shopper or a customer so as to smell a certain product, and the like.

This device and a smaller rounded version as previously described can be of course also realized in other materials such as metal, photo resist etc.

FIGS. 7A and 7B each show a variant of the liquid droplet spray device according to the present invention where the inlet channel is provided in second substrate 3 instead of in first substrate 2 as is shown above. Indeed, as shown in FIG. 7A, an inlet channel 16 is provided traversing the thinner section of second substrate 3 so as to connect an external reservoir with space 4. Advantageously, a buffer volume (not shown) may further be provided, which is connected by a buffer channel 17 to internal space 4. Buffer channel 17 is a passive valve allowing for the liquid substance to transfer from the buffer space to the internal space. This can be done in a manner similar to that as explained in co-pending application EP 01 103 653.0 in the name of the present applicant. The total volume of the internal space then corresponds to the volume of space 4 and that of the buffer space. Advantageously, buffer channel also traverses the thinner section of second substrate 3, but on the opposite end of the substrate as compared to the inlet channel.

In another variant, as shown in FIG. 7B, a centrally disposed inlet channel 27 is provided traversing second substrate 3 to connect the external reservoir to internal space 4.

A further preferred embodiment is shown in FIG. 8. In this embodiment, the housing only consist of one substrate, in this example of second substrate 3 in which the outlet means 7 are arranged in the manner as explained above. A sheet or a ring of foil 10 is provided between piezoelectric element 5 and second substrate 3. When sheet-shaped, this foil 10 seals off both space 4 and outlet means 7 and thus substitutes first substrate 1. When ring-shaped, this foil 10 at least seals off outlet means 7 whereas vibrating element 5 seals off space 4.

Having described a preferred embodiment of this invention, it will now be apparent to one of skill in the art that other embodiments incorporating its concept may be used. It is felt, therefore, that this invention should not be limited to the disclosed embodiment, but rather should be limited only by the scope of the appended claims.

For example, the same liquid droplet spray device may not only be used for atomising medication for respiratory therapies, but it may generally be used for atomising different physico-chemical compositions, e.g. using aqueous or alcoholic or other liquid substances.

What is claimed is:

1. Liquid droplet spray device for atomising a liquid substance, comprising:

a housing comprising a first substrate, a second substrate superposed on the first substrate and a space enclosed by said first and second substrates for containing the liquid substance;

means for supplying said liquid substance to said space;

an outlet means arranged in at least one of said first or second substrates and comprising at least one outlet nozzle and at least one output channel connecting said space to each of said at least one outlet nozzle; and a vibrating element disposed to vibrate liquid in said space so as to eject said liquid substance as a spray through said at least one outlet nozzle;

characterised in that said output channel is a groove provided in an edge portion of at least one of said first and second substrates, wherein each output channel has a first portion and a third portion, said first portion being arranged adjacent said space and having straight sidewalls, said third portion also having straight sidewalls and being arranged adjacent each of said at least one outlet nozzle, the width ($d_1$) of said first portion being larger than the width ($d_2$) of said third portion.

2. Liquid droplet spray devices according to claim 1 wherein said output channel further comprises a second portion arranged between said first portion and said third portion, and connecting said first portion to said third portion such that the width of the output channel changes progressively from the width ($d_1$) of said first portion to the width ($d_2$) of said third portion.

3. Liquid droplet spray device according to claim 1, wherein said housing is round, and said space consists of several individual spaces and wherein several vibrating elements are provided, each arranged to vibrate a liquid substance in one of said spaces.

4. Liquid droplet spray device according to claim 3, wherein said first and second substrates are made of suitably coated and bonded compact disk material.

5. Liquid droplet spray device according to claim 1, wherein said first and second substrates are made of metal or polymer substrate or other wafer like material on which the structure necessary to provide said space or spaces and outlet means has been deposited by suitable deposition processes.

6. Liquid droplet spray device according to claim 1, wherein said outlet means are arranged in said first substrate.

7. Liquid droplet spray device according to claim 1, wherein said outlet means are arranged in said second substrate.

8. Liquid droplet spray device according to claim 1, wherein said outlet means are arranged in said first and in said second substrates.

9. Liquid droplet spray device according to claim 1, wherein said first substrate is constituted by a foil provided between said vibrating element and said second substrate.

10. Liquid droplet spray device according to claim 1, wherein said means for supplying said liquid substance is arranged so as to traverse said first substrate and said vibrating element.

11. Liquid droplet spray device according to claim 1, wherein said means for supplying said liquid substance is arranged so as to traverse said second substrate thus allowing for said liquid substance to enter said space.

12. Liquid droplet spray device according to claim 9, wherein a passive valve is further provided in said second substrate, and wherein said space consists of an inner volume and a buffer volume which are connected to each other by way of said passive valve.

13. Liquid droplet spray device according to claim 2, wherein said housing is round, and said space consists of several individual spaces and wherein several vibrating elements are provided, each arranged to vibrate a liquid substance in one of said spaces.

14. Liquid droplet spray device according to claim 2, wherein said first and second substrates are made of metal or polymer substrate or other wafer like material on which the structure necessary to provide said space or spaces and outlet means has been deposited by suitable deposition processes.

15. Liquid droplet spray device according to claim 3, wherein said first and second substrates are made of metal or polymer substrate or other wafer like material on which the structure necessary to provide said space or spaces and outlet means has been deposited by suitable deposition processes.

16. Liquid droplet spray device according to claim 2, wherein said outlet means are arranged in said first substrate.

17. Liquid droplet spray device according to claim 3, wherein said outlet means are arranged in said first substrate.

18. Liquid droplet spray device according to claim 4, wherein said outlet means are arranged in said first substrate.

19. Liquid droplet spray device according to claim 2, wherein said outlet means are arranged in said second substrate.

20. Liquid droplet spray device according to claim 3, wherein said outlet means are arranged in said second substrate.

21. Liquid droplet spray device according to claim 4, wherein said outlet means are arranged in said second substrate.

22. Liquid droplet spray device according to claim 2, wherein said outlet means are arranged in said first and in said second substrates.

23. Liquid droplet spray device according to claim 3, wherein said outlet means are arranged in said first and in said second substrates.

24. Liquid droplet spray device according to claim 4, wherein said outlet means are arranged in said first and in said second substrates.

25. Liquid droplet spray device according to claim 2, wherein said first substrate is constituted by a foil provided between said vibrating element and said second substrate.

26. Liquid droplet spray device according to claim 3, wherein said first substrate is constituted by a foil provided between said vibrating element and said second substrate.

27. Liquid droplet spray device according to claim 4, wherein said first substrate is constituted by a foil provided between said vibrating element and said second substrate.

28. Liquid droplet spray device according to claim 5, wherein said first substrate is constituted by a foil provided between said vibrating element and said second substrate.

29. Liquid droplet spray device according to claim 6, wherein said first substrate is constituted by a foil provided between said vibrating element and said second substrate.

30. Liquid droplet spray device according to claim 7, wherein said first substrate is constituted by a foil provided between said vibrating element and said second substrate.

31. Liquid droplet spray device according to claim 8, wherein said first substrate is constituted by a foil provided between said vibrating element and said second substrate.

32. Liquid droplet spray device according to claim 2, wherein said means for supplying said liquid substance is arranged so as to traverse said first substrate and said vibrating element.

33. Liquid droplet spray device according to claim 3, wherein said means for supplying said liquid substance is arranged so as to traverse said first substrate and said vibrating element.

34. Liquid droplet spray device according to claim 4, wherein said means for supplying said liquid substance is arranged so as to traverse said first substrate and said vibrating element.

35. Liquid droplet spray device according to claim 5, wherein said means for supplying said liquid substance is arranged so as to traverse said first substrate and said vibrating element.

36. Liquid droplet spray device according to claim 6, wherein said means for supplying said liquid substance is arranged so as to traverse said first substrate and said vibrating element.

37. Liquid droplet spray device according to claim 7, wherein said means for supplying said liquid substance is arranged so as to traverse said first substrate and said vibrating element.

38. Liquid droplet spray device according to claim 8, wherein said means for supplying said liquid substance is arranged so as to traverse said first substrate and said vibrating element.

39. Liquid droplet spray device according to claim 2, wherein said means for supplying said liquid substance is arranged so as to traverse said second substrate thus allowing for said liquid substance to enter said space.

40. Liquid droplet spray device according to claim 3, wherein said means for supplying said liquid substance is arranged so as to traverse said second substrate thus allowing for said liquid substance to enter said space.

41. Liquid droplet spray device according to claim 4, wherein said means for supplying said liquid substance is arranged so as to traverse said second substrate thus allowing for said liquid substance to enter said space.

42. Liquid droplet spray device according to claim 5, wherein said means for supplying said liquid substance is arranged so as to traverse said second substrate thus allowing for said liquid substance to enter said space.

43. Liquid droplet spray device according to claim 6, wherein said means for supplying said liquid substance is arranged so as to traverse said second substrate thus allowing for said liquid substance to enter said space.

44. Liquid droplet spray device according to claim 7, wherein said means for supplying said liquid substance is arranged so as to traverse said second substrate thus allowing for said liquid substance to enter said space.

45. Liquid droplet spray device according to claim 8, wherein said means for supplying said liquid substance is arranged so as to traverse said second substrate thus allowing for said liquid substance to enter said space.

* * * * *